United States Patent [19]

Collins

[11] 4,451,982

[45] Jun. 5, 1984

[54] BOLT ACTION KNIFE

[76] Inventor: Walter W. Collins, 802 Bellwood St., Clover, S.C. 29710

[21] Appl. No.: 286,888

[22] Filed: Jul. 27, 1981

[51] Int. Cl.[3] ..... B26B 1/04

[52] U.S. Cl. ..... 30/161; 30/157

[58] Field of Search ..... 30/160–161, 30/340, 344, 342, 329–331, 321, 244, 255, 260, 151, 155–158, 164

[56] References Cited

U.S. PATENT DOCUMENTS

| | | | |
|---|---|---|---|
| 188,231 | 3/1877 | Booker | 30/161 |
| 576,862 | 2/1897 | Lebold | 30/161 X |
| 770,970 | 9/1904 | Keferstein | 30/161 X |
| 929,295 | 7/1909 | Eilers | 30/157 |
| 1,294,358 | 2/1919 | Henriot | 30/156 X |
| 1,614,949 | 1/1927 | Finley | 145/2 A |
| 1,647,405 | 11/1927 | Giesen | 30/160 |
| 2,461,941 | 2/1949 | Sutton | 30/161 X |
| 2,869,232 | 1/1959 | Kivela | 30/161 |
| 3,868,774 | 3/1975 | Miori | 30/161 |
| 4,242,795 | 1/1981 | Rollband et al. | 30/162 |
| 4,268,960 | 5/1981 | Reinschreiber | 30/161 |
| 4,272,887 | 6/1981 | Poehlmann | 30/161 |

FOREIGN PATENT DOCUMENTS 9493 of 1912 United Kingdom ..... 30/160

*Primary Examiner*—Frederick R. Schmidt
*Assistant Examiner*—Debra S. Meislin
*Attorney, Agent, or Firm*—Klarquist, Sparkman, Campbell, Leigh & Whinston

[57] ABSTRACT

A knife having a blade pivoted to a handle is disclosed with a slidable bolt within the handle, the bolt being extended to lock the blade in an open position and retracted to permit closing of the blade. In one form of the invention, the blade includes a camming portion which retracts the bolt when the blade is opened. Also, a biasing mechanism is provided for urging the bolt into locking engagement with the blade. In another form of the invention, the bolt blade is locked in a closed position until the bolt is retracted. The handle is preferably of a unitary one-piece construction and has walls which define a tapered blade receiving slot. Bushings are held at an angle by these walls so that the bushings bear against the sides of the blade and aid in maintaining the blade in all operating positions. The knife blade is pivoted to the handle in a manner which permits removal of the blade for replacement or repair.

2 Claims, 8 Drawing Figures

FIG. 1
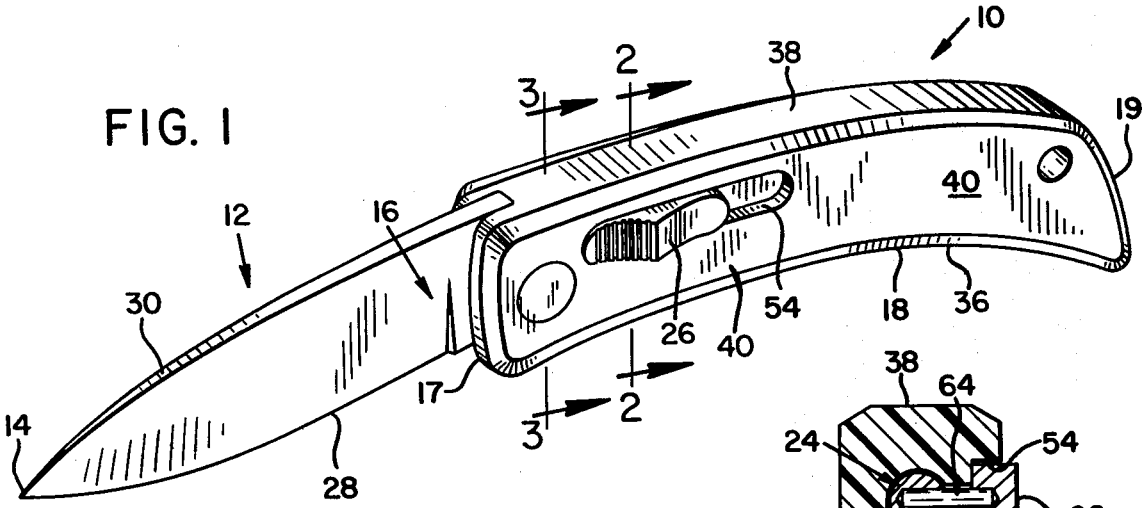
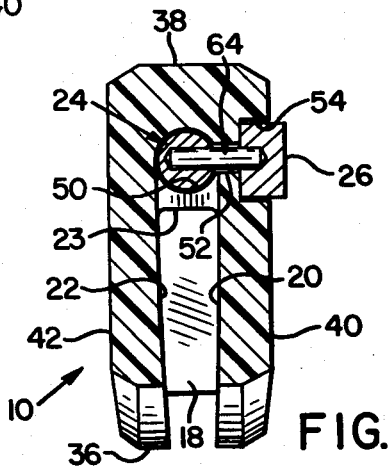
FIG. 2
FIG. 3
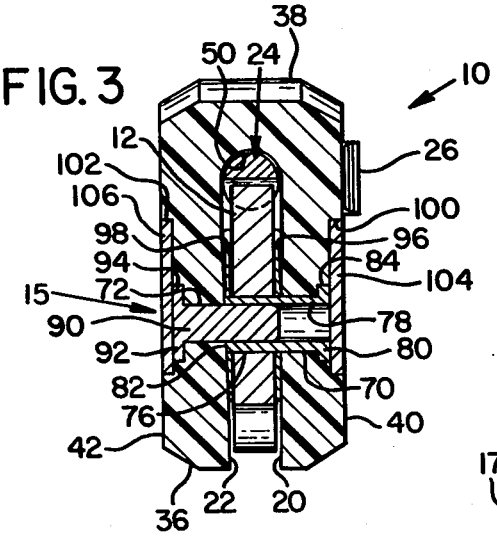
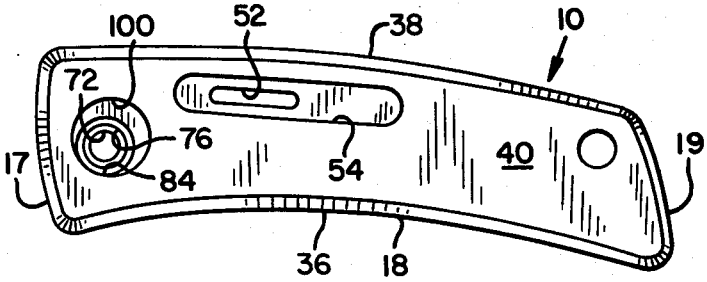
FIG. 4
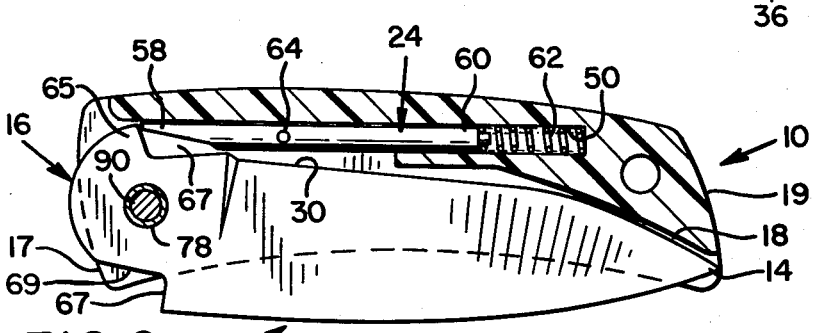
FIG. 6
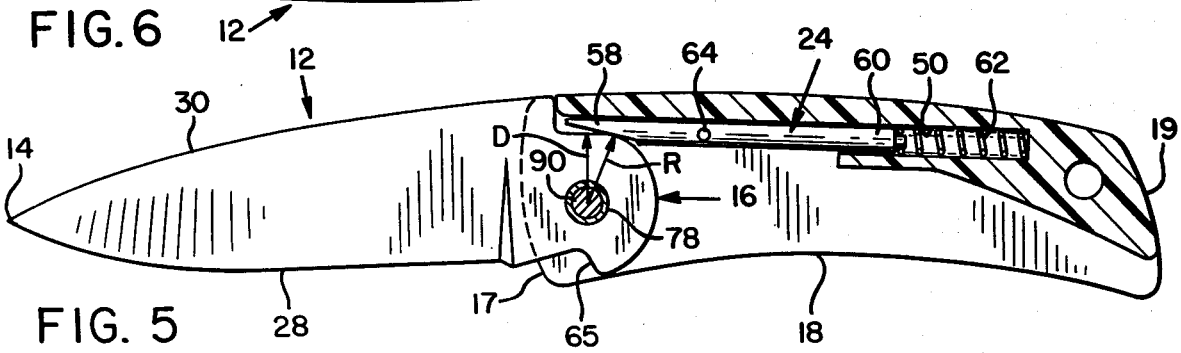
FIG. 5

BOLT ACTION KNIFE

BACKGROUND OF THE INVENTION

This invention relates to a knife of the type having a blade pivoted to a handle, and in particular to such a knife with a bolt for selectively locking the knife blade in a desired position.

Pocket knives and the like are well known in which a blade is pivoted to a handle, with the handle providing a blade receiving slot within which the sharpened edge of the blade is disposed when the knife is closed.

However, one common problem associated with such knives is their tendency to fold-up from an open position, especially when the tip of the knife blade is dug into an object. It is not unusual for this to result in the blade collapsing into the user's hand and cutting it.

Furthermore, in prior knives of this type, handles are typically constructed in a relatively expensive manner, utilizing a number of assembled components.

Also, previously known knives typically utilize blades permanently affixed to a handle. As a result, such knives cannot be taken apart, to, for example, replace a broken or worn out knife blade.

In addition, the blade receiving slots of prior knives are commonly of a uniform width. As a result, as the blade wears, it fits loosely within the slot. Hence, the handle of such knives does not tend to maintain the blade in all positions.

Therefore, a need exists for a new and improved knife which solves these and other problems.

SUMMARY OF THE INVENTION

A knife is disclosed having a handle and a blade pivoted to one end of the handle. The knife includes a sliding bolt mechanism which selectively locks the blade in a desired position. More specifically, this mechanism locks the blade in an open position to prevent the blade from folding closed during use. Also, in one embodiment of the invention, the blade is provided with means, such as a camming portion, which automatically retracts the bolt as the blade is opened. In another form of the invention, the blade is locked in a closed position until the bolt is manually retracted. A biasing mechanism may be provided to urge the bolt mechanism into locking engagement with the blade. In the preferred embodiment, the knife handle is of an economical easily manufactured one piece construction. In addition, removable fastening means may be provided to pivot the blade to the handle so as to permit disassembly of the knife as desired. In addition, the handle may include walls which define a tapered knife receiving slot, with bushings being provided between the blade and walls. The tapered walls hold the bushings at an angle so that the bushings continuously bear against the sides of the knife blade.

It is an overall object of the invention to provide an improved knife of the type having a blade pivoted to a handle;

It is another object of the invention to provide such a knife which is convenient and safe to use;

A further object of the invention is to provide such a knife which is easy and economical to manufacture;

Another object of the invention is to provide a knife of the construction which facilitates repair of the knife;

A further object of the invention is to provide such a knife which is streamlined;

These and other objects, features and advantages of the invention will become apparent with reference to the following drawings and description.

BRIEF DESCRIPTION OF THE DRAWINGS

FIG. 1 is a perspective view of a knife in accordance with the invention;

FIG. 2 is a cross-sectional view of a knife in accordance with the invention, taken along the lines 2—2 of FIG. 1;

FIG. 3 is a cross-sectional view of a knife in accordance with the invention, taken along lines 3—3 of FIG. 1;

FIG. 4 is a side elevational view of a handle of a knife in accordance with the invention;

FIG. 5 is a longitudinal cross-sectional view of a knife of FIG. 1, with the blade in an open position;

FIG. 6 is a longitudinal cross-sectional view of the knife of FIG. 1, with the blade in a closed position;

DETAILED DESCRIPTION OF PREFERRED EMBODIMENTS

Figure 7:
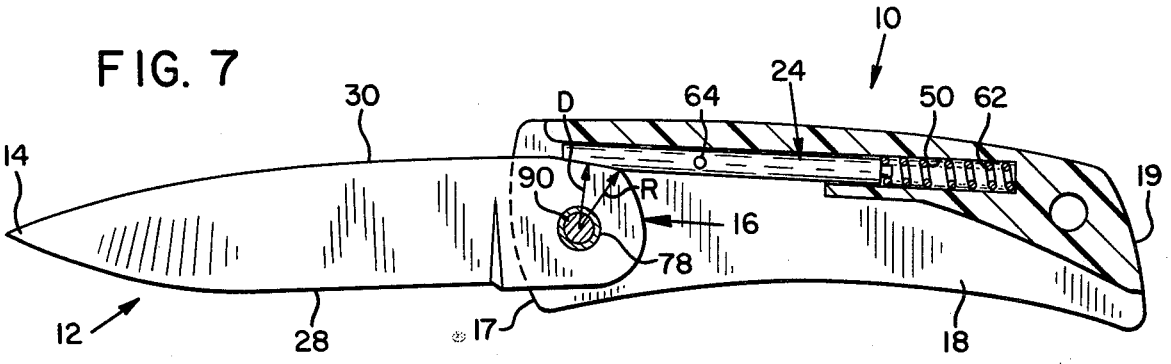
FIG. 7 is a longitudinal cross-sectional view of an alternate embodiment of a knife in accordance with the invention, with the blade in an open position.

With reference to FIG. 1, a knife in accordance with the invention includes a handle 10 and a blade 12. The blade has a tip end 14 and a shank or tail end 16. The shank 16 is pivoted by a pin 15 (see FIG. 3) to a first end 17 of the handle so that the blade may be folded or collapsed into an elongated longitudinal slot 18 defined by walls 20, 22 and a slot base 23 (FIG. 2) of handle 10. An internal bolt mechanism 24, as best seen in FIGS. 5–8, is provided for selectively locking the blade in a desired position, for example, in the open position shown in FIG. 1. The bolt mechanism is thumb actuated, as by a thumb operated button 26 coupled to the bolt mechanism, as explained below.

More specifically, blade 12 includes a sharpened fron edge 28, which is positioned within the slot 18 when the knife is closed, and a back edge 30 opposite the front edge.

As can be seen in FIGS. 2, 3, and 4, handle 10 is preferrably of a unitary one piece construction and may be injected molded, as from a thermal plastic resin material such as of a polyester resin. As such, the handle is extremely economical and easy to produce. In addition to the first end 17, the handle 20 includes a front surface 36, a back surface 38, and first and second side surfaces 40, 42. Front surface 36 defines the mouth or opening of slot 18, which, as previously mentioned, is defined by walls 20, 22, together with the base 23.

Referring to FIG. 3, thin annular bushings 96, 98 are held by pin 15 between the side surfaces of the shank 16 and the respective walls 20, 22 to facilitate pivoting of the blade. Preferably side walls 20, 22 are planar and diverge from handle front surface 36 toward handle back surface 38. As a result, bushings 96, 98 are held at an angle by these side walls so that the bushings converge from handle back surface 38 toward handle front surface 36. Furthermore, the converging portions of these bushings bear snugly against the side surfaces of shank 16 at all times. Consequently, regardless of the position of the knife blade, the bushings bear against the side surfaces of its shank 16 and tend to hold the blade 12 in position. This gripping action is present even after the knife blade wears and facilitates use of the knife. As a specific example, the width of the slot opening is 0.187 inches and the width of the base of the slot is 0.207 inches. Also, the width of the slot opening is greater than the largest width of the blade, which may be 0.125 inches. Also, in this specific example, the width of each of the bushings is 0.031 inches. Of course, if bushings 96, 98 are eliminated, the width of the tapered slot may be reduced correspondingly so that side walls 20, 22 perform this gripping function. In this latter case the slot opening is slightly narrower than the largest width of the shank 16. In addition, handle 10 defines an internal longitudinal cylindrical bolt receiving chamber 50. Chamber 50 is positioned between the base 23 of the slot 18 of the back surface 38 of the handle. The chamber 50 receives one end 60 of a bolt 24 which extends along slot 18 and into engagement with the blade, as explained below.

As best seen in FIG. 2, an elongated pin receiving slot 52, having its axis aligned with the axis of chamber 50, is provided. Slot 52 communicates between side surface 40 of the handle and the chamber 50. Also, a thumb button receiving recess 54 is defined by surface 40. Recess 54 overlays the pin receiving slot and extends both forwardly and rearwardly of such slot.

With reference to FIGS. 5–8, the bolt 24 is formed with a tapered or wedge shaped nose or forward section 58 which is positioned along the base 23 of slot 18. The bolt 24 also includes a cylindrical rear or post section 60 which slides within chamber 50 and is guided thereby. A spring or other biasing mechanism 62, retained within chamber 50, urges the bolt 24 toward the first end 17 of the handle. Referring to FIGS. 1 and 2, a bolt actuating means is provided comprising a button 26 positioned within recess 54 and coupled to the bolt 24 by a pin 64 extending through slot 52. With this construction, the button 26, and hence the pin 64 and bolt 24, is slidable forwardly toward, and rearwardly away from, the first end 17 of the handle 10. Also, the knife is streamlined due to the recessed nature of button 26.

With reference to the embodiment of FIG. 6, at the tail end of the blade 12, and along its front edge 28, a camming portion 65 is provided. This camming portion is positioned adjacent to the forwardmost end of the nose 58 when the blade is closed. Upon manual pivoting of the blade, from the illustrated closed position of FIG. 6 to the open position shown in FIG. 5, the camming portion 65 engages the nose 58 of the bolt and moves the bolt rearwardly against biasing spring 62. As a result, the bolt is automatically retracted as the knife blade is opened.

Also, a portion of the tail end of blade 12 is preferably removed to provide a bolt receiving space bounded by back edge portions 67, 69 of the back edge of the knife. When the blade 12 is moved to its open position as shown in FIG. 5, the nose 58 of the bolt moves forwardly into this space, in response to the bias applied by spring 62. Also, when fully opened, back edge portion 69 abuts a portion of the handle to limit further opening of the blade. The tail end 16 of the blade is of a radius R measured from the pivot of the blade. In addition, the distance D, from the pivot of the blade to edge portion 69 is less than R. As a result, when the nose 58 moves into the bolt receiving space, bolt 24 prevents the blade from folding closed. As a result, the blade will not collapse during use. To fold the blade, the bolt 24 is manually retracted by manipulating button 26 which permits the blade to be rotated to its closed position.

Figure 8:
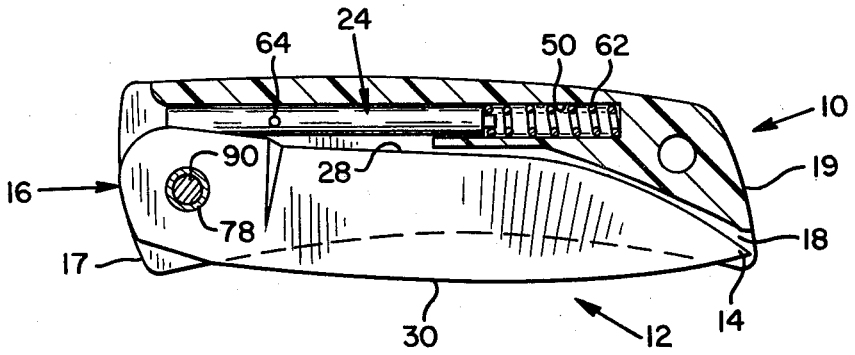
FIG. 8 is a longitudinal cross-sectional view of the knife of FIG. 7, with the blade in a closed position.

In the alternate embodiment illustrated in FIGS. 7 and 8, the blade 12 does not include either a camming portion 65 along its front edge, or a bolt receiving space along its back edge. Thus, when in the closed position, the nose 58 of the bolt engages the shank of the front edge 28 of the blade and prevents the blade from being opened until the bolt 24 is retracted. Upon opening of the blade, the spring moves the bolt forwardly into engagement with the back edge 30 of the blade to thereby lock the knife in the open position. The blade 12 is sized and shaped to permit the nose of the bolt 24 to slide between the base 23 of the handle slot and the back edge 30 of the blade when the blade is opened. Also, the blade is sized and shaped to permit the nose of the bolt to slide between the front edge 28 of the blade and the base 23 of the slot when the blade is closed. This bolt action locks the blade in open and closed positions, as desired.

The blade 12 is preferably pivoted to the handle 10 in a manner that makes the knife easier to manufacture. Also, with this construction the blade may be removed for repair or replacement, if required. More specifically, as shown in FIG. 3, a bore is provided between the side surfaces 40 and 42 of the handle. This bore extends in a direction generally normal to and passes through the slot 18. The bore includes a first bore section 70 of one diameter between wall 20 and surface 40. Also, the bore includes a second bore section 72, of a smaller diameter than that of the first bore section, between wall 22 and surface 42. A circular pivot opening 76 is provided through the tail end 16 of blade 12. The axis of pivot opening 76 is aligned with the axis of bore sections 70, 72 when the tail end 16 of the knife blade is inserted within the slot at the first end 17 of the handle. Pivot pin 15 includes an annular rivet member 78, with a head 80 and free end 82, which is inserted within bore section 70 and through the opening 76 in the blade 12. Rivet member 78 is of a length such that, when its head 80 is positioned within a recess 84 of handle 10, its free end 82 abuts wall 22 of the handle. Also, the diameter of rivet member 78 is only slightly less than that of opening 76 and, as a result, rivet member 78 provides a smooth pivot for the blade 12.

Pivot pin 15 also includes a central rivet member 90, with a head 92, which is inserted through bore section 72 and pressed into annular rivet member 78 to thereby pivot the knife blade 12 to handle 10. The head 92, of rivet member 90, is positioned within a recess 94 of handle 10 when the knife is assembled.

The handle 10 also defines recesses 100, 102, overlying the heads 80, 92 of the rivet members, which receive decorative covers 104, 106. These covers are releasably secured in place, as by an adhesive. As a result, these cover members normally prevent access to the rivet members. However, the cover members can be removed to provide such access. Upon removal of the cover members, the central rivet member 90 may be driven free from the annular rivet member 78 to allow disassembly of the knife. In this manner, the knife blade can be replaced in the event it becomes worn or broken.

Having illustrated and described the principles of my invention with reference to several preferred embodiments, it should be apparent to those skilled in the art that the invention may be modified in arrangement and in detail without departing from such principles. Therefore, I claim as my invention, a knife which falls within the true scope and spirit of the following claims:

What is claimed is:

1. A bolt action folding knife having a blade with a sharpened edge and a shank having one edge extending rearwardly from the sharpened edge of the blade, a handle having an elongated slot for the reception of the sharpened edge of the blade, said shank being pivotally connected to one end of the handle, a bolt slidably mounted to said handle for movement toward and away from the shank, spring means normally urging said bolt into engagement with the shank of the blade to lock the blade in extended position exteriorly of the handle, a camming portion on said one edge of the shank, and said spring means urging the bolt into engagement with the camming portion when the sharpened edge of the blade is closed within the handle, whereby the bolt normally retains the blade in closed position but the camming surface moves the bolt rearwardly with sufficient pressure to overcome the spring means and permits the blade to be pivoted outwardly toward its extended position exteriorly of the handle when the blade is grasped and pulled out of the slot.

2. A knife according to claim 1 including a tapered nose on the bolt and the tapered nose of the bolt engaging the camming portion on the shank when the blade is closed.

* * * * *